US005374211A

United States Patent [19]

Imazato

[11] Patent Number: 5,374,211

[45] Date of Patent: Dec. 20, 1994

[54] LIFESAVING DEVICES

[75] Inventor: Mitsuo Imazato, Kawasaki, Japan

[73] Assignee: Takata Corporation, Tokyo, Japan

[21] Appl. No.: 178,857

[22] Filed: Jan. 7, 1994

[30] Foreign Application Priority Data

Jan. 14, 1993 [JP] Japan ..... 5-020718

[51] Int. Cl.[5] ..... B63C 9/00

[52] U.S. Cl. ..... 441/84; 441/80; 114/365

[58] Field of Search ..... 441/80, 90, 91, 92, 441/93, 94, 88, 35, 40, 41, 42, 84; 114/365, 375, 345

[56] References Cited

U.S. PATENT DOCUMENTS 3,433,323 3/1969 Ukawa ..... 441/80
4,332,049 6/1982 Fisher ..... 441/80
4,498,879 2/1985 Burr ..... 441/80

*Primary Examiner*—Stephen P. Avila
*Attorney, Agent, or Firm*—Kanesaka & Takeuchi

[57] ABSTRACT

A lifesaving device is formed of a plurality of gas charge devices, a plurality of cylindrical bodies each of which has one end connected to one of said gas charge devices corresponding thereto and the other end which is closed, each of said cylindrical body having an outer configuration of generally flat plate in deflated condition, and a cylindrical body holding member for holding said cylindrical bodies in the deflated condition to be folded therein or wound-up thereon, wherein said cylindrical bodies are inflated and deployed simultaneously in response to operation of the respective gas charge devices to the extent that a predetermined buoyancy force is obtained.

10 Claims, 6 Drawing Sheets

LIFESAVING DEVICES

BACKGROUND OF THE INVENTION

This invention relates to a lifesaving device and, more particularly, to a lifesaving device carried by a vessel or the like that can be released and floated on the surface of water in case of distress, allowing crews and passengers to be buoyed up until help arrives.

Vessels for sea or lake cruising are obliged to equip certain legal apparatus under the Ship Safety Law and life appliances are of particular importance among them. The details for the life appliances are defined by the Regulation for the Ship-borne Lifesaving Appliance. More specifically, the type(s) and the number of the appliances that should be equipped on a vessel are fully defined for the individual vessel depending on its type, purpose and capacity as well as where it travels. The life appliances can be classified generally into two groups:

(1) water-borne or floating appliances; and (2) signal apparatus for rescue.

The floating apparatus defined by law includes lifeboats, life rafts, buoyant apparatus, life buoys and life jackets.

Typical buoyant apparatus used as a lifesaving device comprises a block-like floating buoy. The block-like floating buoy has, as a buoy body, an air-tight box made of metal plates having sufficient corrosion resistance and a life line is passed around the buoy body. The buoyant apparatus is held in a predetermined position of the deck side on a vessel and is launched into water in an emergency. Crews and passengers can float in water while holding the life line and wait for rescue with an assistance of the buoyancy force.

Specifications for the buoyant apparatus defined by the Regulation for the Ship-borne Lifesaving Appliance require that at least eight persons can be buoyed up by a single buoyant apparatus having a predetermined peripheral length and sufficient buoyancy force to buoy the victims positively. The buoyant apparatus just after being launched is ought to be linked to the vessel in distress through a painter. In addition, to equip the life line along the periphery of the buoyant apparatus is also one of the requirements obliged by the Regulation for the Ship-borne Lifesaving Appliance.

The buoyant apparatus is classified into a non-inflatable type and an inflatable type according to the structure of the buoy body. The non-inflatable buoyant apparatus may comprise the above mentioned air-tight block made of metal. Alternatively, it is made essentially of a material lighter than water including woods such as balsa and kapok and a closed cell or (expanded) vinyl sponge. On the contrary, typical inflatable buoyant apparatus is composed of a rubber bag or the like held in deflated condition in an enclosure and inflated in an emergency with injected gas.

The buoyant apparatus used as the lifesaving device should have a predetermined floating capacity to ensure the buoyancy sufficient for the victims, i.e., 14.5 kg for one person. Besides, the outer periphery of the floating buoyant apparatus should exceed a predetermined length to ensure sufficient space for the victims to hold the life line. With this respect, each vessel or ship is obliged to equip the buoyant apparatus having enough capacity to obtain sufficient buoyancy force for the maximum number of persons on board. Accordingly, the non-inflatable buoyant apparatus, if being used, occupies a large portion of the free-space on the narrow deck because it is carried in a predetermined stowed away position at the deck side. This means that the space required for the buoyant apparatus, where otherwise is used effectively for other equipment, significantly restricts a design or a layout of the vessel.

On the contrary, the inflatable buoyant apparatus has no problem regarding to the spacing. However, a bag having relatively large capacity must be inflated to the extent that a predetermined peripheral length can be obtained. The inflatable buoyant apparatus is thus normally stowed away together with a source of pressurized gas for inflating it. This source is relatively large in dimension and has a disadvantage of increasing the total weight of the inflatable buoyant apparatus.

SUMMARY OF THE INVENTION

Accordingly, an object of the present invention is to overcome the above mentioned conventional problems and to provide a lifesaving device that can be contained in a small container. Another object of the present invention is to provide a lifesaving device for vessels capable of being deployed rapidly to an adequate shape for ensuring a predetermined buoyancy force and peripheral length on the surface of water when an emergency situation arises.

On describing the gist of an aspect of this invention, provided is a lifesaving device comprising a gas charge device; a cylindrical body having one end connected to the gas charge device and the other end which is closed, the cylindrical body having an outer configuration of generally flat plate in deflated condition; and a cylindrical body holding member for holding the cylindrical body in the deflated condition with being folded therein or wound-up thereon, wherein the cylindrical body is inflated and deployed in response to operation of the gas charge device to the extent that a predetermined buoyancy force is obtained.

The lifesaving device of the present invention is kept normally as a small package and the gas charge device adequately inflates and deploys the cylindrical body or bodies thereof rapidly into a predetermined shape in an emergency. Thus, it becomes possible to obtain a large buoyancy force and peripheral length sufficient for many victims thrown into the water.

The cylindrical body is a resin-coated hose formed of a woven fabric as a base fabric made into a cylinder and coated with a resin. The base fabric is textured with warps extending along the length of the cylinder to be spaced away from and in parallel to each other, a first set of helixwound wefts passing among the warps at a predetermined angle in a first direction, and a second set of helixwound wefts also passing among the warps at the predetermined angle in a second direction opposed to the first direction. Such combination of a resin and a woven fabric contributes to reduction of a manufacturing cost for the lifesaving device.

In addition, the lifesaving device preferably comprises at least two cylindrical bodies, each of which is held by the cylindrical body holding member in such a manner that the cylindrical bodies are in parallel and associated with each other at a predetermined distance when being deployed completely. In this event, the adjacent cylindrical bodies are preferable to be kept at the predetermined distance by means of a spacer attached to them. With the spacer, it is possible to elongate the total length of the periphery of the lifesaving device when being deployed completely.

In the present invention, it is preferable that the cylindrical body holding member is a container capable of holding the cylindrical body or bodies and has a generally rectangular parallel-piped shape with a side broken by a pressurized force from the inside generated as a result of operation of the gas charge device. Alternatively, the cylindrical body holding member is preferably a reel capable of holding the cylindrical body or bodies with being wound around it. The cylindrical body holding member formed as a container can be stowed away with less spacing. In addition, the cylindrical body holding member formed as a reel contributes to rapid and easy deployment of the cylindrical body.

The cylindrical body holding member is preferably made of a material lighter than water having a predetermined buoyancy force when being launched on water. With this structure, it becomes possible to carry some first-aid kits on the cylindrical body holding member.

These and other objects and features of the present invention will become more fully apparent from the following description and appended claims taken in conjunction with the accompanying drawing.

BRIEF DESCRIPTION OF THE DRAWINGS

FIG. 5(*b*) is a partial cross sectional view showing a modification of the end of the resin hose; FIG. 5(*c*) is a partial perspective view of the end of the resin hose shown in FIG. 5(*b*);

FIG. 6(*b*) is a view corresponding to FIG. 6(*a*) except that the lifesaving devices are in released and launched conditions;

DESCRIPTION OF THE PREFERRED EMBODIMENTS

Figure 1:
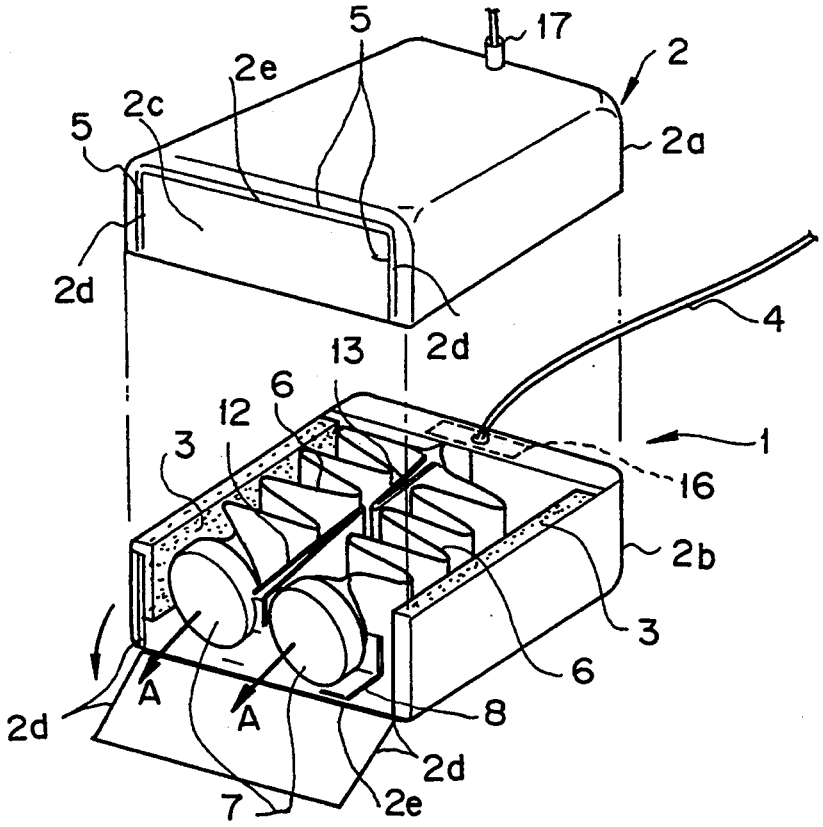
FIG. 1 is an exploded perspective view schematically illustrating a lifesaving device according to a first embodiment of the present invention.

A lifesaving device according to an embodiment of the present invention is now described referring to the drawing. Throughout the following detailed description, similar reference numerals refer to similar elements and parts in all figures.

Figure 2:
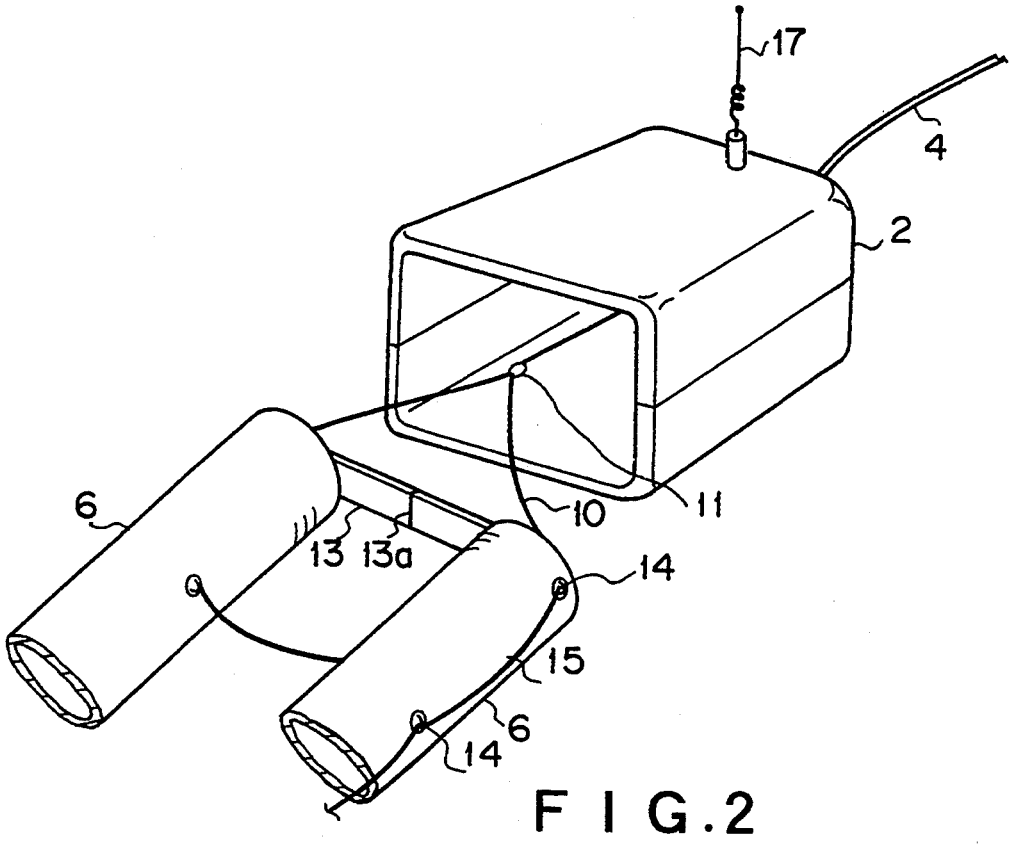
FIG. 2 is a partial perspective view illustrating resin hoses used as buoy bodies of the lifesaving device shown in FIG. 1, in which the buoy bodies are inflated and deployed completely.

Referring to FIG. 1, a lifesaving device according to a first embodiment of the present invention is shown in an exploded manner. In FIG. 1, a lifesaving device 1 comprises a container 2 of generally rectangular parallel-piped in shape. The container 2 is made of fiber glass reinforced plastic (FRP) and consists of two halves, i.e., an upper half 2*a* and a lower half 2*b*. The container 2 has a side 2*c* divided into two pieces and has edges 2*d* and 2*e*. The inner surface of the container 2 is provided with thin plates of expanded or foamed polystyrene 3 adhered thereto. Accordingly, the container 2 floats in water even with the sides 2*c* being opened as shown in FIG. 2.

As shown in FIG. 1, a painter 4 is attached to the container 2 at one side opposed to the side 2*c* thereof. The side 2*c* is provided with a notch 5 (overlapped with the edges 2*d* and 2*e* in FIG. 1). The notch 5 is formed in the outer periphery of the side 2*c* to ensure that the side 2*c* is opened when a pressurized force is applied thereto from the inside of the container 2. To this end, the container 2 is preferable to be formed such that only the edges 2*d* are broken in response to the application of the pressurized force while the other opposing edges 2*e* remain in a hinged manner. However, it should be understood that the side 2*c* may be torn away by the notch 5*c*.

Two resin hoses 6 are folded in the container 2 with being juxtaposed to each other. Each resin hose 6 has an end 6*a* hermetically sealed by welding. The other end 6*b* of the resin hose 6 is provided with a gas injection opening described below. The gas injection opening is communicated with a gas discharge outlet (not shown) of a corresponding gas cylinder 7. Each gas cylinder 7 is generally flat-cylindrical in shape and is contained in the container 2 with being supported by a flange 8 such that a bottom thereof contacts with the inner surface of the side 2*c*. Filled within the gas cylinder 7 is carbon dioxide gas that is sufficient in pressure and capacity for inflating the resin hose 6. A gas injection valve (not shown) is interposed between the gas cylinder 7 and the gas injection opening of the resin hose 6 and a well-known safety seal-plate is provided as a dividing plate.

As described more in detail below, a cut mechanism is disposed at the top of the gas discharge outlet to cut the safety seal-plate. When an operational line (not shown) is withdrawn, a firing hammer or a firing pin implemented in the cut mechanism is thrown away through the safety seal-plate to provide a communication between the gas injection opening of the resin hose 6 and the gas discharge outlet of the gas cylinder 7. The carbon dioxide gas is thus introduced into the resin hose 6.

FIG. 2 shows the resin hoses 6 inflated completely to a predetermined configuration by the gas supplied from the respective gas cylinders 7. It should be understood that each resin hose 6 initially inflates within the container 2. As the gas is injected into the resin hoses 6 in an increased amount to fill the container 2, the gas cylinders 7 are urged outward in the direction depicted by an arrow A due to the reaction of the gas injection. As a result, the gas cylinders 7 are forced against the side 2c. The side 2c is opened at the notch 5 when this pressurized force exceeds a predetermined value. Two gas cylinders 7 are thrown outside the container 2, following which the resin hoses 6 extend outward while being inflated. The gas is injected continuously into the resin hoses 6 until they are inflated and deployed completely outside the container 2.

Each resin hose 6 has an end 6a (FIG. 5(a)) where a coupling line 10 is attached that extends in a predetermined length between the resin hose 6 and the container 2. More particularly, one end of the coupling line 10 is connected to the end 6a of the resin hose 6 and the other end of thereof is connected to the container 2 through a swivel 11. The swivel 11 contributes to ensure the safety when the container 2 is launched in any directions.

Spacers 12 and 13 are attached between the juxtaposed ends of the resin hoses 6. Each of the spacers 12 and 13 is made of a resin material formed into a thin plate. Thus, the resin hoses 6 are spaced away from each other at a predetermined distance (approximately 50 cm in this embodiment). The plate-like resin spacers 12 and 13 are folded to half a length between the resin hoses 6 and contained in the container 2 when the resin hoses 6 are retained within the container 2. As apparent from FIG. 2, the spacers 12 and 13 are expanded into plates at pleat lines 12a *and* 13a, respectively, once the resin hoses 6 are ejected out of the container 2 and completely deployed.

In addition, small rings made of a resin are attached to resin hoses 6 along the length thereof at a predetermined distance to provide eye holes 14 for a lifeline 15. The lifelines 15 is passed through the eye holes 14 along the longitudinal periphery of the resin hose 6. Victims thrown into water can thus wait for rescue with their hands holding this life line 15.

Other components provided in the container 2 are as follows. An SOS signal generator 16 is disposed within the container 2. The SOS signal generator 16 has a whip antenna 17 implemented therein. The whip antenna 17 is projected outside the container 2 at the same time, when the resin hoses 6 are ejected away from the interior of the container 2 to generate an SOS signal indicating where the emergency arises. While not shown in the figures, a self-activating smoke signal generator and a self-igniting light are also secured in a holder within the container 2. The victims can notice rescuers the location within the visible area where they are by using the self-activating smoke signal generator and the self-igniting light.

Figure 3:
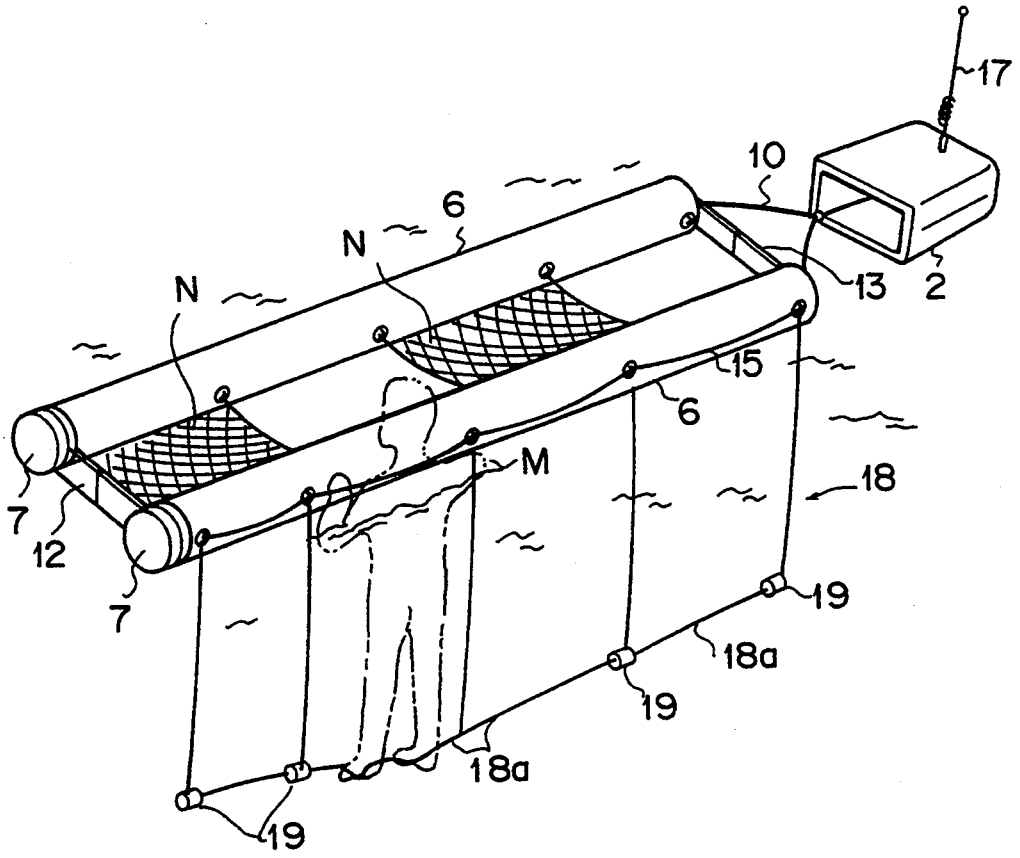
FIG. 3 diagrammatically illustrates resin hoses of the lifesaving device shown in FIG. 1, in which the resin hoses are used on the surface of water.

FIG. 3 is a view diagrammatically illustrating the resin hoses 6 of the lifesaving device 1 used in water.

As shown in the figure, two resin hoses 6 are apart from each other at a predetermined distance by the spacers 12 and 13. Nets N are stretched between the hoses 6. By laying a body on the net N, it is possible to save energy for people of older/younger ages including a baby to "save" physical strength or power as compared with staying in water.

Crews and passengers wearing a life jacket can hold the life line 15 with some aid of the buoyancy force of the jacket. However, a man M if not wearing the life jacket might buoy up only by his power. With this respect, a supplemental line 18 is provided under the water on which the man M can put his feet and stabilize his body with less power. The supplemental line 18 is provided with weights at predetermined positions and is sunk under the water, allowing the man M to put his feet thereon more easily.

While the lifesaving device shown in FIG. 3 is illustrated for eight persons or so, it is readily understood those lifesaving devices for more persons can be made simply by means of elongating the resin hoses 8. Such elongated resin hoses are more advantageous in consideration with the Regulation defining the length of the outer periphery of the lifesaving devices. With the elongated resin hoses 6, the size of the container 2 and the gas-charge capacity of the gas cylinder 7 may be modified adequately depending for each case.

Figure 4:
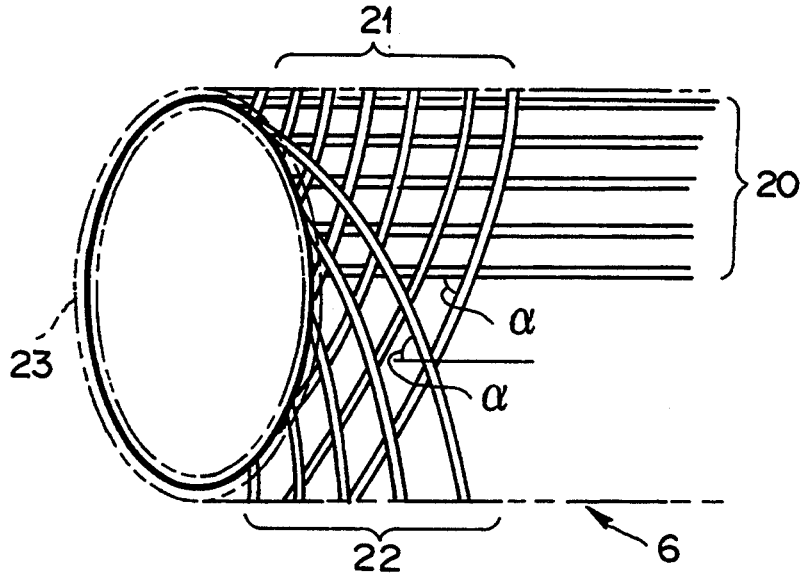
FIG. 4 is a view for use in describing a resin hose formed of reinforced fibers used as a base.
Figure 5:
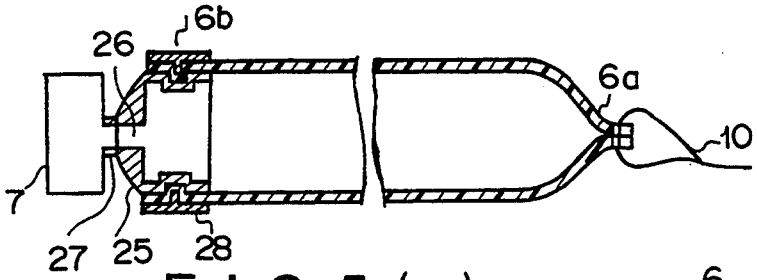
FIG. 5(*a*) is a foreshortened cross-sectional view of a resin hose applicable to the present invention, illustrating two ends thereof with being adequately treated.
Figure 5:
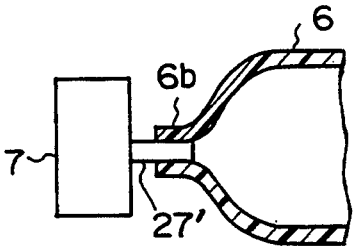
Figure 5:
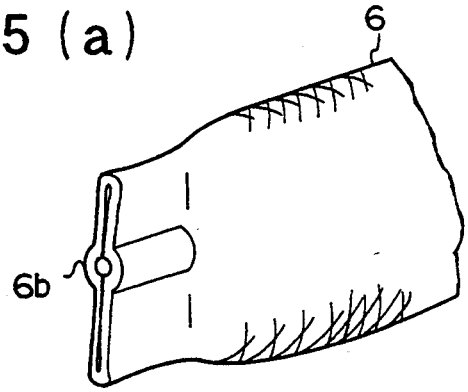

The resin hose 6 is now described more in detail referring to FIGS. 4 and 5.

The resin hose 6 is essentially formed of a woven fabric (a base fabric) coated with a resin. As shown in FIG. 4, the base fabric is textured with warps 20 extending along the length of the hose 6 to be spaced away from and in parallel with each other and helixwound wefts 21 and 22 passed among the warps 20 at a predetermined angle alpha relative to the warps 20. More specifically, the wefts 21 are wound in a helical fashion at the angle in a first direction, and the wefts 22 are wound at the same angle in a second direction opposed to the first direction. Thus, the base fabric is made as a bundle of reinforced fibers of double-helixwound into a hose. The warps 20 and the wefts 21 and 22 are made of a polyester resin having a size of approximately 1,500 deniers (d) per one strand. The strand is made of threads stranded approximately 50 times/m. In addition, the angle alpha is equal to 54.7 degree, which is referred to as the angle of friction. At this angle, the extension of the fibers in the axial direction of the hose is balanced with the expansion thereof in the direction of the hoop. The base fabric so formed is used as a core and the inner and outer surfaces thereof are coated with a non-rigid polyvinyl chloride resin 23 through impregnation to form the resin hose 6.

During the impregnation, the base fabric formed into a cylinder is impregnated into a chamber filled with a molten resin where the resin is penetrated into the fabric. The resultant product is then heated in a heat chamber into a hose having a predetermined shape. The hose is pressed into flat and folded by an embossing machine during the subsequent steps. In this way, the hose is made that has a plate-like configuration in the deflated condition when no internal pressure acts thereon.

A significant feature of the resin hose 6 is to be floated on the surface of water, so that less or no dynamic load is applied thereto when being inflated and deployed. Accordingly, it is preferable to select a material for the hose on the basis of the weather resistance and the temperature resistance (i.e., the cold resistance and the thermal resistance) thereof. With this respect, the non-rigid polyvinyl chloride resin may be substituted by a thermoplastic elastomer resin. Suitable thermoplastic elastomer resin includes styrene resins, olefin resins, polyurethane resins and polyamide resins.

In addition, the resin portion of the hose may be molded by the extrusion molding rather than the above mentioned impregnation. In the extrusion molding, the base fabric is passed through an extrusion die having a cylindrical shape. A pressurized molten resin is injected into the die and is uniformly penetrated into the fabric. The die is then filled with the resin to provide a resin hose having a predetermined shape.

FIG. 5 is a view showing the ends of the inflated resin hose. In FIG. 5(a), the inner surface of the end portion 6a facing to the container 2 is hermetically sealed by welding to secure hermetic sealing thereof. The overlapped portion is provided with a hole through which one end of the coupling line 10 is tied to the resin hose 6.

The other end portion 6b of the resin hose 6 is engaged with a coupler 25. The coupler 25 is cylindrical in shape and the diameter thereof is slightly larger than the inner diameter of the hose 6. Provided at approximately center of the coupler 25 is a gas injection opening 26. A gas discharge outlet 27 of the gas cylinder 7 is inserted into the gas injection opening 26. The coupler 25 is clamped to the hose 6 by a clamp band 28 to avoid the coupler 25 from being separated from the hose 6 when the carbon dioxide gas is discharged from the gas cylinder 7.

FIG. 5(*b*) shows a variation of the end portion 6*a* in a cross section while FIG. 5(*c*) shows the same portion in a partial perspective view. In these figures, a gas discharging pipe 27′ is integrally connected to the end portion 6*a* of the hose 6. The gas discharging pipe 27′ is extended from the gas cylinder 7 and is secured to the hose by welding. With this structure, the coupler 25 can be omitted and the entire structure thus becomes more compact and small than that having the coupler 25 when being contained in the container 2.

It is noted that the outer surface of the gas discharging pipe 27 may be knurled or provided with a convex ring to prevent the gas discharging pipe 27 from being escaped from the hose 6 during gas injection.

Figure 6:
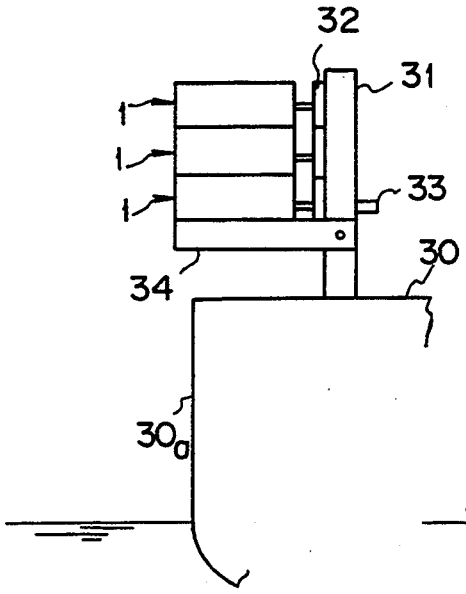
FIG. 6(*a*) schematically shows the lifesaving devices according to the present invention in a ship-borne condition.
Figure 6:
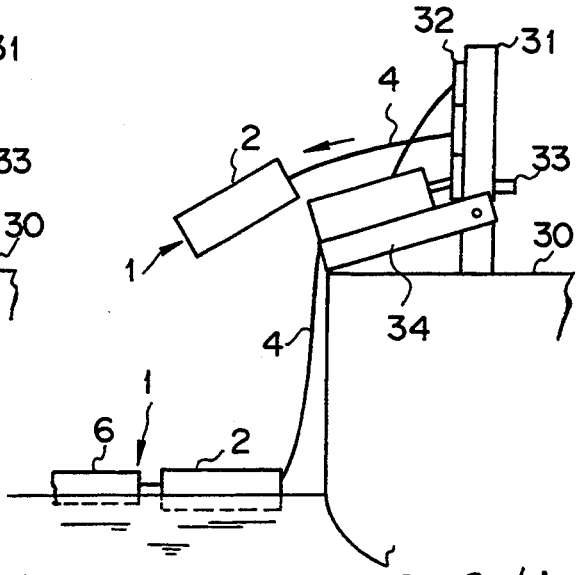

Next, application of the lifesaving devices according to the present invention is described in conjunction with FIGS. 6(*a*) and 6(*b*) where the lifesaving devices are illustrated in a ship-borne condition and in a launched condition, respectively.

One or more lifesaving devices are carried by a ship 30 with being secured to a mast 31 standing upward at a deck side 30*a*. The lifesaving devices are secured through a throwing device 32 such that they are not moved in the normal position by a movement of the ship. In this embodiment, three lifesaving devices 1 are piled up as shown in FIG. 6(*a*).

When an emergency arises, a lock of a boom 34 is released by means of operating a release lever 33 provided at the mast 31. As a result, the boom 34 is inclined as shown in FIG. 6(*b*) and simultaneously a rope or a band used for securing the containers 2 is loosed. The container 2 located at the top of the pile is first thrown into water, and the remaining containers 2 fall down successively. Each container is coupled with the ship 30 through the painter 4. The painter 4 has a length sufficiently longer than the draft height of the ship 30 to prevent the lifesaving device 1 from being flown away from the ship 30. The painter 4 is released from the lifesaving device 1 at an adequate timing if the ship 30 should sink. The victims can thus move outside the region where relatively strong flow of water is generated due to the sinking of the ship.

The connection between the painter 4 and the container 2 is achieved by means of a mechanical locking mechanism and the painter 4 is readily released only by removing a safety device.

In the present embodiment, the safety seal-plate is broken by the cut mechanism in response to the operation of the operational line at the same time when the container 2 is released. Accordingly, the gas begins to be flown from the gas cylinder 7 into the resin hose 6 at that time. The side 2*c* (FIG. 1) of the container 2 is broken while being fallen down. When the lifesaving device 1 is launched on water, the resin hoses 6 are in the course of deployment or has already been deployed completely.

In case where there is no time to throw the lifesaving devices 1 into water before the ship 30 has sunk under the water, the container 2 may be separated from the ship 30 under the water by means of a well-known automatic separating mechanism and floated up on the surface of water. In this event, inflation of the resin hose 6 may be started at the same time when the container 2 is separated from the ship 30.

Figure 7:
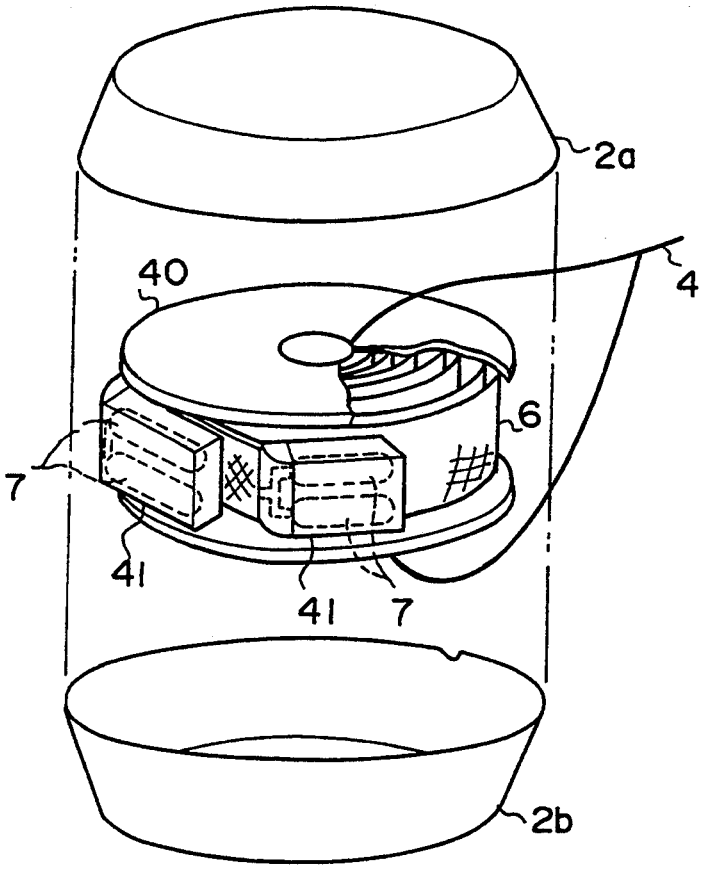
FIG. 7 is an exploded perspective view schematically illustrating a lifesaving device according to a second embodiment of the present invention.
Figure 8:
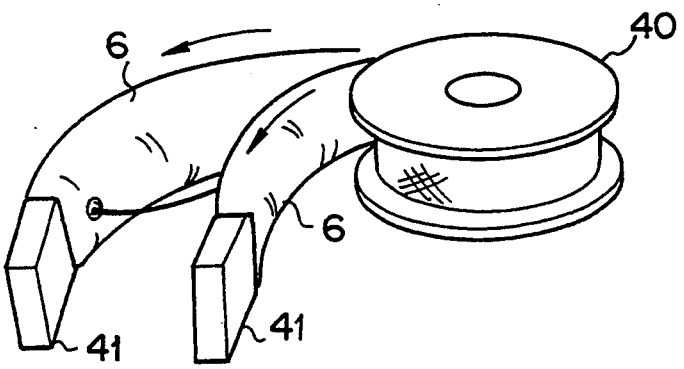
FIG. 8 is a perspective view illustrating resin hoses of the lifesaving device shown in FIG. 7 in the course of being inflated.
Figure 9:
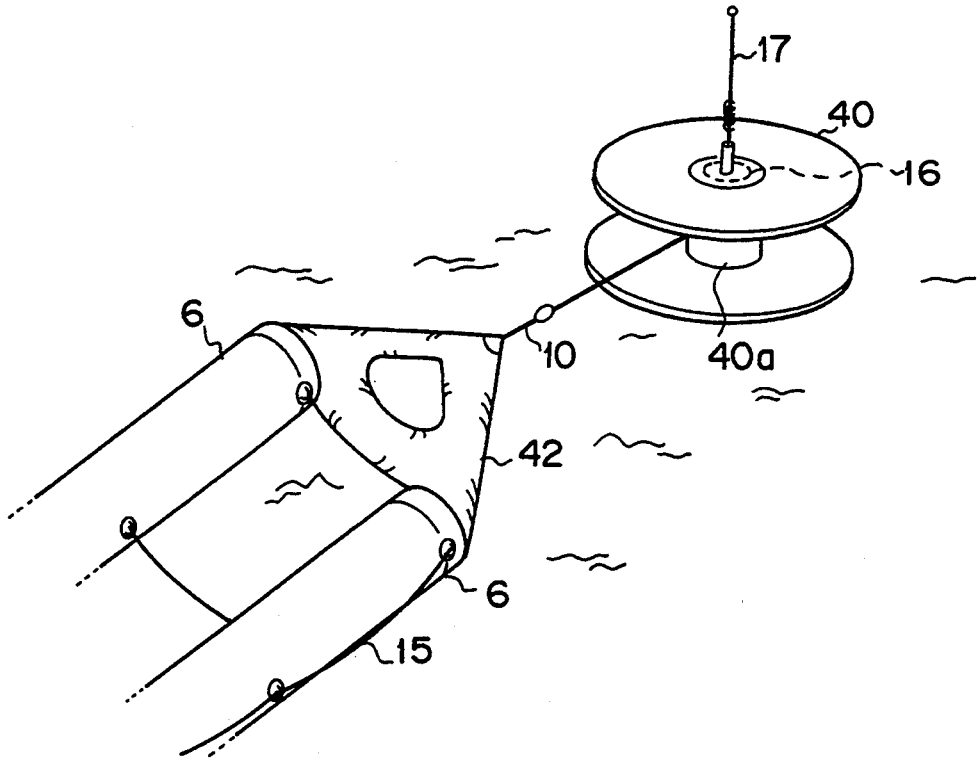
FIG. 9 is a partial perspective view illustrating the resin hoses inflated and deployed completely.

Another embodiment of the present invention is now described referring to FIGS. 7 through 9.

FIG. 7 is an exploded perspective view schematically illustrating a lifesaving device comprising a container 2 of generally flat cylinder in shape. The container 2 is made of FRP and consists of two halves 2*a* and 2*b*.

In the figure, a reference numeral 40 represents a buoyant reel. The above mentioned resin hoses 6 in the deflated condition are wound-up on the buoyant reel 40. An end of each resin hose 6 exposed to the outside is connected to a gas cylinder container 41. The gas cylinder container 41 has a generally rectangular parallelpiped configuration that is suitable to be contained at around the periphery of the reel. Located within the gas cylinder container 41 is the gas cylinder 7 that is similar in structure and in operation to the cylinder 7 described in conjunction with the first embodiment. The gas cylinder 7 is capable of injecting the gas into the resin hose 6 associated therewith.

FIG. 8 is a perspective view illustrating the resin hoses 6 wound-up on the reel 40 that is in the course of inflation by the gas cylinder 7. The resin hoses 6 are wound-off the reel 40 as being inflated and deployed. Accordingly, the resin hoses 6 in a small container are deployed rapidly into a sufficient dimension.

FIG. 9 is a view corresponding to FIG. 2 in the first embodiment.

In this embodiment, inflatable spacers 42 are used in place of the spacers 12 and 13 described in conjunction with the first embodiment. Each of the spacers 42 is generally triangular in shape and formed as a bag. In addition, it has two vertices connected to the respective resin hoses 6. The spacers 42 are folded along a core 40*a* of the reel 40 when the resin hoses 6 are contained in the container. Each of the spacers 42 has a gas injection opening communicated with either one of the resin hoses 6 and is thus inflated into generally triangular in shape simultaneously with the inflation of the hoses 6. As in the spacers 12 and 13, the spacers 42 also contribute to keep a predetermined distance between two hoses 6.

In this embodiment, the SOS signal generator 16 is also implemented in the core 40*a* and the antenna 17 is extended upward at the same time when the coupling line 10 is stretched during the inflation of the hoses 6. Other equipment including the life line 15 is similar to that described in conjunction with the first embodiment.

Next, variations of the resin hoses are described below with reference to FIGS. 10 and 11.

Figure 10:
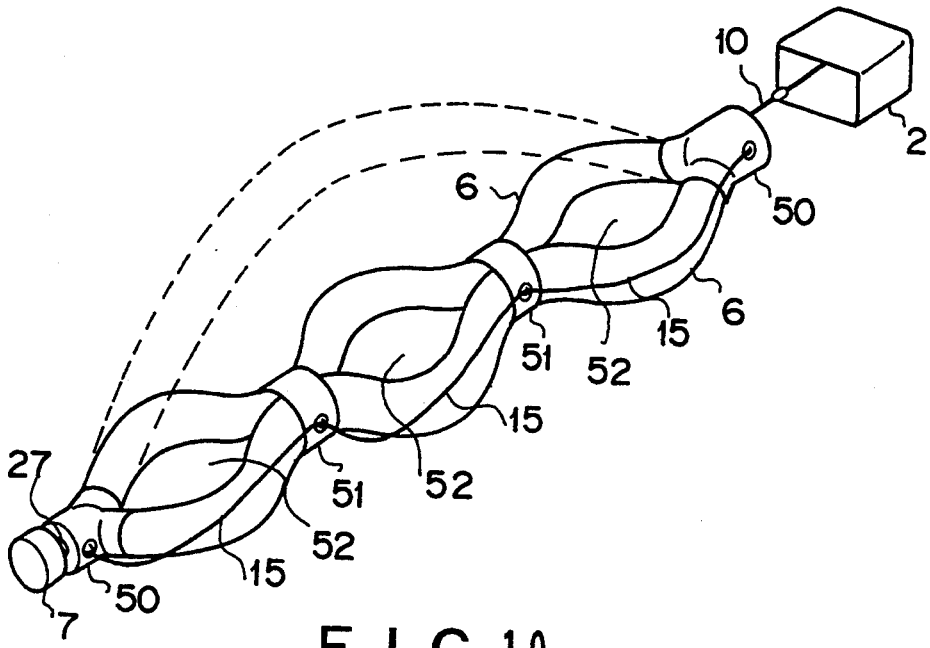
FIG. 10 is a perspective view showing a first variation of the resin hoses applicable to the present invention.

Each end of the resin hoses 6 shown in FIG. 10 is provided with a branch coupler 50. The resin hoses connected to the branch coupler 50 are tied together with resin bands 51 at the positions corresponding to one-third and two-thirds of the length thereof. When the band 51 is not provided, the resin hose 6 may be deployed into an arch-shaped balloon as indicated by phantom in FIG. 10. With the bands 51, three circular spaces 52 are formed between the resin hoses 6. The size of each space 52 is designed such that a person may enter. Accordingly, the person may be supported by the resin hoses that serve as a float or a tire to buoy him up on water.

The branch coupler 50 at the distal end is connected to the gas cylinder 7 through the gas discharging pile 27. It is possible, in this variation, to inflate two resin hoses with a single gas cylinder 7. In addition, the eye holes 14 may be formed in the band 51 and the branch coupler 50 to eliminate attachment of the resin rings to the external surface of the resin hoses 6 as in the case described in the first embodiment.

Figure 11:
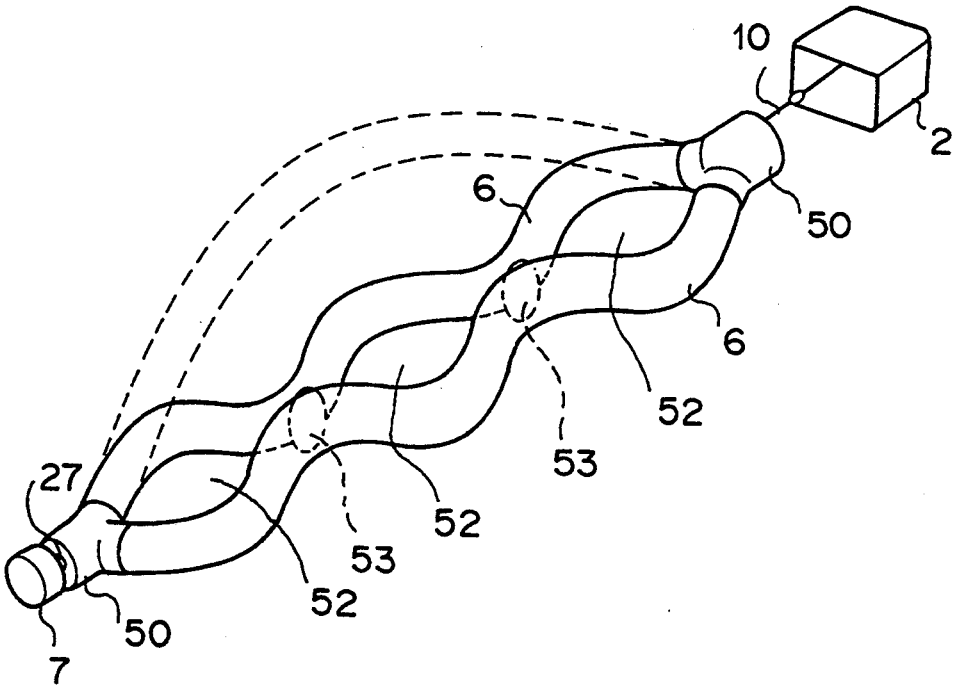
FIG. 11 is a partial plan view showing a second variation of the resin hoses applicable to the present invention.

FIG. 11 shows another variation of the present invention where a portion of the resin hoses 6 are welded without using the bands 51. In this embodiment, the similar effects can be achieved to those obtained in the above mentioned embodiments.

While the present invention has thus been described in conjunction with the lifesaving devices used as the buoyant apparatus according to the Regulation for the Ship-borne Lifesaving Appliance, the present invention may be used for other various applications rather than for the lifesaving by means of modifying it in a manner well-known from those skilled in the art.

As apparent from the above mentioned description, the present invention is advantageous in that it can be carried by a vessel or the like in a small container during normal cruising and deployed rapidly in an emergency into a configuration having sufficient buoyancy force and length for the victims.

It should be understood that the present invention is not limited to the particular embodiment shown and described above, and various changes and modifications may be made without departing from the spirit and scope of the appended claims.

What is claimed is:

1. A lifesaving device comprising:

a plurality of gas charge devices, a plurality of inflatable cylindrical bodies connected at respective ends to the gas charge devices, each cylindrical body being formed of a woven fabric in a cylindrical form and a resin coated on the woven fabric, each cylindrical body being flattened and folded when the cylindrical body is not inflated, and a container for receiving the gas charge devices and the cylindrical bodies in a folded condition therein, said container having buoyancy to float in water and a side portion, said container containing the gas charge devices and the cylindrical bodies, in use, being discharged into water so that while the container floats in water, the gas charge devices are actuated to inflate the cylindrical bodies, said side portion being broken by the inflated cylindrical bodies to allow the inflated cylindrical bodies to exit from the container and to float in water.

2. A lifesaving device according to claim 1, wherein said cylindrical bodies are folded in a direction perpendicular to the side portion so that when the gas charge device is actuated, the side portion is directly pushed by the cylindrical bodies and the cylindrical bodies can easily exit from the container.

3. A lifesaving device according to claim 2, further comprising two spacers connected at two longitudinal ends of the cylindrical bodies so that the cylindrical bodies are arranged side by side at a predetermined distance away from each other when inflated.

4. A lifesaving device according to claim 3, wherein each spacer is formed of a thin plate made of a resin material, said spacer, when retained in the container, being folded and placed between the cylindrical bodies.

5. A lifesaving device according to claim 4, wherein said cylindrical bodies include life lines attached thereto so that a user can hold the life lines.

6. A lifesaving device according to claim 5, further comprising an SOS signal generator installed in the container, said generator actuating when the cylindrical bodies are discharged from the container.

7. A lifesaving device comprising:

a plurality of gas charge devices, a plurality of inflatable cylindrical bodies connected at respective ends to the gas charge devices, each cylindrical body being formed of a woven fabric in a cylindrical form and a resin coated on the woven fabric, each cylindrical body being flattened and folded when the cylindrical body is not inflated, and a buoyant reel around which the cylindrical bodies in a flattened condition are wound, said buoyant reel with the cylindrical bodies and the gas charge devices, in use, being discharged into water so that while the reel floats in water, the gas charge devices are actuated to inflate the cylindrical bodies to thereby separate said cylindrical bodies from the reel and to float in water.

8. A lifesaving device according to claim 7, further comprising a spacer connected at longitudinal ends of the cylindrical bodies so that the cylindrical bodies are arranged side by side at a predetermined distance away from each other when inflated.

9. A lifesaving device according to claim 8, wherein said cylindrical bodies include life lines attached thereto so that a user can hold the life lines.

10. A lifesaving device according to claim 9, further comprising an SOS signal generator installed in the reel, said generator actuating when the cylindrical bodies are inflated.

* * * * *